United States Patent [19]

Mifune et al.

[11] 4,323,643

[45] Apr. 6, 1982

[54] SILVER HALIDE PHOTOGRAPHIC LIGHT-SENSITIVE MATERIALS

[75] Inventors: Hiroyuki Mifune; Shigeo Hirano; Yoshitaka Akimura, all of Minami-ashigara, Japan

[73] Assignee: Fuji Photo Film Co., Ltd., Minami-ashigara, Japan

[21] Appl. No.: 204,666

[22] Filed: Nov. 6, 1980

[30] Foreign Application Priority Data

Nov. 6, 1979 [JP] Japan ..... 54/144158

[51] Int. Cl.[3] ..... G03C 5/24; G03C 1/02

[52] U.S. Cl. ..... 430/441; 430/448; 430/444; 430/446; 430/445; 430/949; 430/564; 430/523; 430/539; 430/567; 430/602; 430/609; 430/598; 430/599; 430/600; 430/607; 430/613

[58] Field of Search ..... 430/949, 448, 441, 444, 430/446, 445, 564, 523, 539, 567, 602, 609, 598, 599, 600, 607, 613

[56] References Cited

U.S. PATENT DOCUMENTS

| | | | |
|---|---|---|---|
| 4,031,127 | 6/1977 | Leone et al. | 430/598 |
| 4,168,977 | 9/1979 | Takada et al. | 430/564 |
| 4,243,739 | 1/1981 | Mifune et al. | 430/564 |

FOREIGN PATENT DOCUMENTS

| | | | |
|---|---|---|---|
| 53-16623 | 2/1978 | Japan | 430/564 |

*Primary Examiner*—Won H. Louie, Jr.

*Attorney, Agent, or Firm*—Sughrue, Mion, Zinn, Macpeak and Seas

[57] ABSTRACT

A silver halide photographic light-sensitive material is described, comprising at least one silver halide photographic emulsion layer, wherein at least one layer contains a compound represented by formula (I)

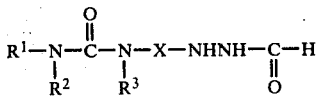

(I)

wherein $R^1$ and $R^2$ each represents hydrogen, an aliphatic group, an aromatic group, or a heterocyclic group;

$R^3$ represents hydrogen or an aliphatic group, and

X represents a divalent aromatic group.

The light-sensitive material provides high-contrast negative images and good dot image quality.

19 Claims, No Drawings

SILVER HALIDE PHOTOGRAPHIC LIGHT-SENSITIVE MATERIALS

BACKGROUND OF THE INVENTION

This invention relates to silver halide photographic light-sensitive materials and, more particularly, to photographic light-sensitive materials providing extremely high-contrast negative images and good dot image quality.

It is known to add hydrazine compounds to silver halide photographic emulsions or developers, as described, for example, in U.S. Pat. No. 3,730,727 (developer containing ascorbic acid and hydrazine), U.S. Pat. No. 3,227,552 (the use of hydrazine as an auxiliary developing agent for obtaining direct positive color images), U.S. Pat. No. 3,386,831 (containing $\beta$-monophenylhydrazine of an aliphatic carboxylic acid as a stabilizer for silver halide light-sensitive materials), and U.S. Pat. No. 2,419,975 as well as in Mees and James, *The Theory of the Photographic Process*, 3rd Edition, page 281 (1966), etc.

In particular, U.S. Pat. No. 2,419,975 discloses that high-contrast negative images are obtained by the addition of hydrazine compounds. This patent describes that extremely high-contrast photographic characteristics, such as a gamma ($\gamma$) of more than 10, can be obtained by adding a hydrazine compound to a silver chlorobromide emulsion and developing at a pH as high as 12.8. However, a strong-alkaline developer having a pH of nearly 13 is susceptible to air oxidation and is too unstable to be stored or used for long period of times.

Super-high-contrast photographic characteristics of more than 10 in gamma are extremely useful, in either negative image or positive image, for the photographic reproduction of continuous gradation images as dot images, which are useful for making printing plates, or for reproduction of line images. For the purpose of obtaining such photographic characteristics, a process has generally been used wherein a silver chlorobromide emulsion containing more than 50 mol%, and preferably more than 75 mol%, silver chloride is used, and is developed by a hydroquinone-containing developer having an extremely low (usually lower than 0.1 mol/liter) effective density of sulfite ion (hereinafter "lithographic developer").

However, in such a process the developer is very unstable due to the low sulfite ion concentration in the developer, and hence cannot stably be stored for more than 3 days.

Moreover, since processes as described above require the use of silver chlorobromide emulsions having a relatively high silver chloride content, it has been impossible to obtain a high sensitivity by such processes. Therefore, it has been strongly desired to obtain super-high-contrast photographic characteristics useful for the reproduction of dot images and line images using a highly sensitive silver halide emulsion and a stable developer.

We have previously disclosed that extremely high contrast negative image is obtained using a stable developer by developing a silver halide photographic material in the presence of some types of acylhydrazine compound, such as $R^1NHNHCOR^2$ (wherein $R^1$ represents an aryl group, $R^2$ represents hydrogen, a phenyl group and an alkyl group) and $X^1(Ar^2\text{-}B)_nAr^1\text{—}NHNHCOR^2$ (wherein $X^1$ represents a group having —CS—NH— unit, $Ar^1$ and $Ar^2$ each represents a divalent aromatic group, B represents a divalent linking group, n represents 0 or 1 and $R^2$ is the same as above), in U.S. Pat. No. 4,168,977, West German Patent Publication (ALS) No. 2,725,743 and West German Patent Application (OLS) No. 2,941,428. However, the acylhydrazine compounds used therein have proved to possess some defects.

One of these defects is that since the pH of the developer most suitable for obtaining good contrast images and dot images is relatively high, viz., higher than about 11, the stability of the developer when stored for a long period of time is still considered insufficient, although the stability is remarkably high as compared with conventional lithographic developers.

Since as the pH of a developer is lowered, the occurrence of oxidation of developing agent decreases, and the stability of the developer stored for a long period of time increases, more active hydrazine compounds providing high contrast images and good dot image quality at low pH have been keenly desired.

A second defect is that using the hydrazine compounds previously disclosed it is difficult to obtain good dot quality and extremely high-contrast image using silver halide emulsions having relatively large grain sizes (e.g., a mean grain size of larger than 0.7 $\mu$m).

This is undesirable because increasing the grain size of the silver halide is a very fundamental means for increasing the sensitivity of silver halide emulsion, and hence compounds are desired which provide high-contrast even in case of using silver halide emulsions having large silver halide grains.

A third defect is that the screen range obtained by developing a silver halide photographic material in the presence of an acylhydrazine compound disclosed previously is smaller than screen range obtained by using conventional lithographic light-sensitive materials and lithographic developers.

By the term "screen range" is meant a difference between a logarithmic value of the exposure amount for providing a larger dot area (usually dot having a blacken area of 95%) and a logarithmic value of the exposure amount for providing a smaller dot area (usually dot having a blacken area of 5%) in the case of converting the change of a density having continuous gradation of original image into the change in dot area by means of exposure through a contact screen, and the larger the screen range is, the more preferable is, because of being capable of being uniformly converted as the change in dot area from the high density portion to the low density portion.

For obtaining high-quality prints having good gradation reproduction, it is preferred that the dot gradation is as soft as an extent obtained by a combination of a lithographic photographic light-sensitive material and lithographic development, but since the acylhydrazine compounds previously disclosed give considerably hard dot gradation (i.e., slightly poor gradation reproduction), compounds capable of providing softer dot gradation have been desired.

SUMMARY OF THE INVENTION

An object of this invention is to provide silver halide photographic light-sensitive materials for providing very high contrast negative images and good dot quality and dot gradation, using a stable developer having a relatively low pH.

Another object of this invention is to provide silver halide light-sensitive materials providing high contrast negative images and good dot quality even by using silver halide emulsions having relatively large silver halide grain size.

The aforesaid objects of this invention have now been attained by using silver halide photographic light-sensitive material comprising at least one silver halide photographic emulsion containing surface latent image type silver halide grains, wherein at least one layer contains a compound represented by formula (I)

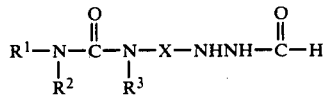

(I)

wherein $R^1$ and $R^2$ (which may be the same of different) each represents hydrogen, an aliphatic group, an aromatic group or a heterocyclic group;

$R^3$ represents hydrogen or an aliphatic group; and

X represents a divalent aromatic group.

DETAILED DESCRIPTION OF THE INVENTION

The compounds of formula (I) are more particularly explained below.

The aliphatic groups represented by $R^1$ and $R^2$ of formula (I) include a straight chain or branched chain alkyl group, a cycloalkyl group, a substituted cycloalkyl group, an alkenyl group, and an alkynyl group. Examples of the straight chain or branched chain alkyl groups are alkyl groups each having from about 1 to 18, and preferably from 1 to 10 carbon atoms. Preferred examples include a methyl group, an ethyl group, an isobutyl group, a t-octyl group, etc.

Also, the cycloalkyl group has generally from 3 to 10 carbon atoms and preferred examples thereof are a cyclopentyl group, a cyclohexyl group, an adamantyl group, etc. Examples of the substituent for the cycloalkyl group are an alkoxy group (e.g., a methoxy group, an ethoxy group, a propoxy group, a butoxy group, etc.), a halogen atom (e.g., chlorine, bromine, fluorine, iodine, etc.), an alkoxycarbonyl group, an aryl group (e.g., a phenyl group, a halogen-substituted phenyl group, an alkoxyphenyl group, an alkylphenyl group, etc.), a hydroxy group, a cyano group, a sulfonyl group, etc. Preferred examples of the substituted cycloalkyl group are a 3-methoxypropyl group, a 4-chlorocyclohexyl group, a benzyl group, a p-methylbenzyl group, a p-chlorobenzyl group, etc. Also, examples of the alkenyl group include an allyl group, etc., and examples of the alkynyl group include a propargyl group, etc.

On the other hand, examples of the aromatic groups shown by $R^1$ and $R^2$ include a phenyl group, a naphthyl group, including those having substituents (e.g., an alkyl group, an alkoxy group, an acylhydrazino group, a cyano group, a dialkylamino group, an alkoxycarbonyl group a carboxy group, a nitro group, an alkylthio group, a hydroxy group, a sulfonyl group, a carbamoyl group, a halogen atom, etc.). Preferred examples of the substituted groups are, for example, a p-methoxyphenyl group, an o-methoxyphenyl group, a tolyl group, a p-formylhydrazino group, a p-chlorophenyl group, an m-fluorophenyl group, etc.

The heterocyclic ring group shown by $R^1$ and $R^2$ is a 5-membered or 6-membered single ring, or a condensed ring, having at least one of oxygen, nitrogen, sulfur, and selenium atoms, and these heterocyclic groups may have substituents. Preferred examples of the heterocyclic groups are a pyrroline ring, a pyridine ring, a quinoline ring, an indole ring, an oxazole ring, a benzoxazole ring, a naphthoxazole ring, an imidazole ring, a benzimidazole ring, a thiazoline ring, a thiazole ring, a benzothiazole ring, a naphthothiazole ring, a selenazole ring, a benzoselenazole ring, a naphthoselenazole ring, etc.

These heterocyclic ring groups may be substituted by an alkyl group having from 1 to 4 carbon atoms, such as a methyl group, an ethyl group, etc.; an alkoxy group having from 1 to 4 carbon atoms, such as a methoxy group, an ethoxy group, etc.; an aryl group having from 6 to 18 carbon atoms, such as a phenyl group, etc.; a halogen atom such as chlorine, bromine, etc.; an alkoxycarbonyl group, a cyano group, an amido group, etc.

It is preferred that at least one of $R^1$ and $R_2$ be hydrogen.

The aliphatic group shown by $R^3$ includes a straight chain or branched chain alkyl group, a cycloalkyl group, a substituted cycloalkyl group, an alkenyl group, and an alkynyl group. The straight chain or branched chain alkyl group is generally an alkyl group having from 1 to 18 carbon atoms, and preferably from 1 to 6 carbon atoms, and preferred examples thereof are a methyl group, an ethyl group, an isopropyl group, etc. The cycloalkyl group generally has from 3 to 10 carbon atoms, and preferred examples thereof are a cyclopentyl group, a cyclohexyl group, etc. Examples of the substituent include an alkoxy group (e.g., a methoxy group, an ethoxy group, etc.), an alkoxycarbonyl group, an aryl group (e.g., a phenyl group, a halogen-substituted phenyl group, an alkoxyphenyl group, an alkylphenyl group, etc.), an amido group, an acyloxy group, etc. Preferred examples of such substituted groups include a 3-methoxypropyl group, a benzyl group, a p-chlorobenzyl group, a p-methoxybenzyl group, a p-methylbenzyl group, etc. Examples of the alkenyl group include those having from 3 to 12 carbon atoms, such as an allyl group, a 2-butenyl group, etc.

$R^3$ is preferably hydrogen.

X represents a divalent aromatic group and preferred examples thereof include, for example, a phenylene group, a naphthylene group (e.g., 1,2-naphthylene, 1,4-naphthylene, 2,3-naphthylene, 1,5-naphthylene, and 1,8-naphthylene groups), and substituted groups thereof.

Examples of the divalent aromatic groups include, for example, an alkyl group having from 1 to 20 carbon atoms (the group may be branched), an aralkyl group the alkyl moiety of which has from 1 to 3 carbon atoms, an alkoxy group (having preferably from 1 to 20 carbon atoms), a substituted alkoxy group (having preferably from 1 to 20 carbon atoms), an alkyl group, and a substituted alkyl group (having from 1 to 20 carbon atoms), and these groups may include a mono- or di-substituted amino group, an aliphatic acylamino group (having preferably from 2 to 21 carbon atoms), an aromatic acylamino group, an alkylthio group, a hydroxy group, a halogen atom (e.g., chlorine), and so forth.

X is preferably a phenylene group.

Preferred compounds among the compounds represented by formula (I) are those represented by formula (II)

$$R^1-NHC(=O)NH-X-NHNHCHO \quad (II)$$

wherein $R^1$ and X have the same meaning as in formula (I).

Preferred examples of the preferred compounds represented by formula (I) are shown below:

1. 1-Formyl-2-[4-(3-phenylureido)phenyl]hydrazine
2. 2-{4-[3-(4-Chlorophenyl)ureido]phenyl}-1-formylhydrazine
3. 2-{4-[3-(2-Chlorophenyl)ureido]phenyl}-1-formylhydrazine
4. 1-Formyl-2-{4-[3-(4-methoxyphenyl)ureido]phenyl}-hydrazine
5. 1-Formyl-2-{2-methoxy-4-[3-(4-methylphenyl-)ureido]phenyl}hydrazine
6. 1-Formyl-2-{4-[3-(2-methoxyphenyl)ureido]phenyl}-hydrazine
7. 2-{4-[3-(3-Acetamidophenyl)ureido]phenyl}-1-formylhydrazine
8. 1-Formyl-2-[3-(3-phenylureido)phenyl]hydrazine
9. 1-Formyl-2-[4-(3-methylureido)phenyl]hydrazine
10. 2-[4-(3-Ethylureido)phenyl]-1-formylhydrazine
11. 1-Formyl-2-[4-(3-propylureido)phenyl]hydrazine
12. 2-[4-(3-Butylureido)phenyl]-1-formylhydrazine
13. 2-[4-(3-t-Butylureido)phenyl]-1-formylhydrazine
14. 1-Formyl-2-[4-(3-pentylureido)phenyl]hydrazine
15. 2-[4-(3-Dodecylureido)phenyl]-1-formylhydrazine
16. 1-Formyl-2-[4-(3-octadecylureido)phenyl]hydrazine
17. 2-[4-(3-Cyclohexylureido)phenyl]-1-formylhydrazine
18. 2-[4-(3-Benzylureido)phenyl]-1-formylhydrazine
19. 2-[4-(3-Allylureido)phenyl]-1-formylhydrazine
20. 2-[4-(3-Ethoxycarbonylmethylureido)phenyl]-1-formylhydrazine
21. 1-Formyl-2-{4-[3-(2-pyridyl)ureido]phenyl}hydrazine
22. 1-Formyl-2-{4-[3-(2-thienyl)ureido]phenyl}hydrazine
23. 2-[4-{3-[3-(2,4-di-t-Amylphenoxyacetamido)phenyl-]ureido}phenyl]-1-formylhydrazine
24. 2-{4-[3-(2-Benzothiazolyl)ureido]phenyl}-1-formylhydrazine
25. 1-Formyl-2-{4-[3-(4-methylthiazol-2-yl)ureido]-phenyl}hydrazine The compounds of formula (I) used in this invention can be generally synthesized by the following method:

First, by reacting 4- or 3-nitrophenylhydrazine and formic acid or a corresponding acid anhydride or acid chloride, 2-(4- or 3-nitrophenyl)-1-formylhydrazine can be obtained. These nitrophenylhydrazines can be easily converted into corresponding amino compounds by catalytically reducing them in a solvent such as an alcohol (e.g., ethanol, methyl cellosolve, etc.) and dioxane using palladium-carbon as a catalyst or heating them together with reduced iron in an alcohol. By reacting the amino compounds thus-obtained and various sorts of isocyanates or the precursors thereof in a non-protonic polar solvent such as dimethylformamide, acetonitrile, tetrahydrofuran, dioxane, etc., the desired compounds of formula (I) can be prepared.

The raw materials for producing the compounds of this invention, and synthesis methods for the compounds of this invention will be particularly described below:

I. SYNTHESIS OF RAW MATERIALS

(1) 2-(4-Nitrophenyl)-1-formylhydrazine 459 g of 4-nitrophenylhydrazine was gradually added to 1.6 liters of acetonitrile, and then 322 g of formic acid was added to form a homogeneous solution, and, after 20 minutes, crystals formed. After allowing the reaction to proceed for 2 hours at a temperature of 80° C., the reaction system was cooled and the crystals formed were recovered by filtration, washed with acetonitrile, and dried, to provide 493 g of 2-(4-nitrophenyl)-1-formylhydrazine. Melting point: 184° to 186° C.

(2) 2-(4-Aminophenyl)-1-formylhydrazine

In 1,600 ml of ethanol, 30 g of 2-(4-nitrophenyl)-1-formylhydrazine was catalytically reduced at room temperature, using palladium-carbon as a catalyst. The reaction mixture was filtered and the filtrate was evaporated to dryness, whereby 20.5 g of white solid 2-(4-aminophenyl)-1-formylhydrazine was obtained. Melting point: 123° to 125° C.

(3) 2-(3-Nitrophenyl)-1-formylhydrazine

By reacting 3-nitrophenylhydrazine as in the same manner as (1), 430 g of 2-(3-nitrophenyl)-1-formylhydrazine was obtained. Melting point: 168° to 169° C.

(4) 2-(3-Aminophenyl)-1-formylhydrazine

By reacting 2-(3-nitrophenyl)-1-formylhydrazine in an analogous manner as in (2), 21.0 g of 2-(3-aminophenyl)-1-formylhydrazine was obtained. Melting point: 108° to 113° C.

II. SYNTHESIS OF THE COMPOUNDS OF THIS INVENTION

(5) Synthesis of Compound 1

23 g of 2-(4-aminophenyl)-1-formylhydrazine was dissolved in a mixture of 75 ml of dimethylformamide and 750 ml of acetonitrile, and, while stirring the solution at a temperature of from −5° C. to −10° C., 18.1 g of phenyl isocyanate dissolved in 75 ml of acetonitrile was added dropwise to the solution. Then, after further continuing the reaction for 2 hours at the same temperature, the crystals formed were recovered by filtration. Crude crystals were dissolved in 300 ml of dimethylformamide and the solution is filtered. To the filtrate was added 1.5 liters of methanol, and the crystals formed were recovered by filtration to provide 28.7 g (70% in yield) of the desired product. Melting point: 221° to 222° C. (decomposed).

(6) Synthesis of Compound 2

9.1 g of 2-(4-aminophenyl)-1-formylhydrazine was dissolved in a mixture of 60 ml of dimethylformamide and 30 ml of acetonitrile, and, while stirring the solution at −15° C., 9.2 g of 4-chlorophenyl isocyanate dissolved in 30 ml of acetonitrile was added dropwise to the solution. After further continuing the reaction for 2 hours at temperatures of from −15° C. to −10° C., 200 ml of acetonitrile is added and crystals formed were recovered by filtration and washed with 200 ml of acetonitrile. The crude crystals were dissolved in 120 ml of dimethylformamide and the solution was filtered. 800 ml of methanol was added to the filtrate, and the crystals formed was recovered by filtration to provide 14 g (77% yield) of the desired product. Melting point: 233° to 235° C. (decomposed).

(7) Synthesis of Compound 3

By following an analogous procedure as in producing Compound 2 described above, using 9.1 g of 2-(4-aminophenyl)-1-formylhydrazine and 9.2 g of 2-chlorophenyl isocyanate, 15 g (82% yield) of the desired product was obtained. Melting point: 221° to 233° C. (decomposed).

(8) Synthesis of Compound 12

30 ml of an acetonitrile solution of 5.9 g of butyl isocyanate was added dropwise to a mixture of 9.1 g of 2-(4-aminophenyl)-1-formylhydrazine, 30 ml of dimethylformamide, and 30 ml of acetonitrile at −15° C. After causing the reaction to proceed for 3 hours at a temperature of −15° C. to −10° C., 200 ml of acetonitrile was added to the reaction mixture, and the crystals formed were recovered by filtration and recrystallized from 350 ml of ethanol to provide 9 g (60% in yield) of the desired product. Melting point: 178° to 180° C. (decomposed).

(9) Synthesis of Compound 17

In a mixture of 25 ml of dimethylformamide and 35 ml of acetonitrile, 4.8 g of 2-(4-aminophenyl)-1-formylhydrazine and 3.8 g of cyclohexyl isocyanate were reacted with each other in an analogous manner as for Compound 2 described above, and the product was reprecipitated with 50 ml of dimethylformamide and 300 ml of acetone, whereby 5.7 g (69% yield) of the desired product was obtained. Melting point 211° to 213° C. (decomposed).

(10) Synthesis of Compound 20

In a mixture of dimethylformamide and acetonitrile, 7.9 g of 2-(4-aminophenyl)-1-formylhydrazine and 6.5 g of ethyl isocyanoacetate were reacted with each other in an analogous manner as for Compound 2 described above and the product was reprecipitated with dimethylformamideacetonitrile, whereby 10.5 g (75% yield) of the desired product was obtained. Melting point: 191° to 192.5° C. (decomposed).

Other compounds of this invention can be similarly synthesized according to the methods described above.

The reaction and mechanisms of the compounds of formula (I) are not completely clear, but it is believed that since the compounds do not exhibit the effect merely by the presence of the compounds at exposure, they do not act simply as a halogen acceptor as described in T. H. James, *The Theory of the Photographic Process,* 4th Edition, page 158 (published by Macmillan & Co.). Also, since the light-sensitive material of this invention does not form images without the action of developing agents as described hereinafter, the compounds do not act as a developing agent. What is observed is that the compounds increase the sensitivity and gradation of the light-sensitive materials, as well as providing good dot images and good dot gradation by the presence thereof at development.

When incorporating a compound of this invention represented by formula (I) in photographic light-sensitive materials, the compound may be incorporated in one or more hydrophilic colloid layers. It is preferred that the compound of formula (I) be incorporated in a layer containing a silver halide photographic emulsion of a surface latent image type but the compound may be incorporated in other non-light-sensitive layers such as, for example, a protective layer, interlayers, a filter layer, an antihalation layer, etc. The compound can be incorporated as a solution in an organic solvent miscible with water, such as alcohols (e.g., methanol, ethanol), esters (e.g., ethyl acetate), and ketones (e.g., acetone) or, in the case of the compound being water-soluble, as an aqueous solution thereof in a hydrophilic colloid solution.

In the case of adding the compound to a silver halide photographic emulsion, the compound may be added at any desired period from the initiation of chemical ripening to before coating, but it is preferred to add the compound after finishing chemical ripening. It is particularly preferred to add the compound to a coating composition prepared for coating.

It is preferred that the compound of this invention represented by formula (I) be incorporated in an amount of from $10^{-6}$ mol to $5\times10^{-2}$ mol, and preferably from $10^{-5}$ mol to $2\times10^{-2}$ mol per mol of silver halide, but it is desirable to select the optimum amount of the compound according to the grain size of silver halide emulsion, the halogen composition, the manner and extent of chemical sensitization, the relationship between the layer containing the compound and the silver halide photographic emulsion layer and the kind of antihalation compounds. For example, as shown in Examples 1 and 3 described below, the compound of this invention is added in the silver halide photographic material changing added amounts of said compound, and it is desirable to decide the optimum amount of the compound from the result described above. The most appropriate compound and amount thereof for a particular use can be easily selected by a test well known for persons skilled in the art.

It is preferred that silver halide grains used for at least silver halide emulsion layer in this invention be of substantially surface latent image type. By the term "substantially surface latent image type" used in this invention is meant that when a light-sensitive material prepared without using the compound of this invention is developed by surface development (A) and internal development (B) shown below after an imagewise exposure of from 1 to 1/100 sec., the sensitivity obtained by surface development (A) is higher than the sensitivity obtained by internal development (B).

In this case, the sensitivity is defined as follows:

$$S=(100)/(Eh)$$

wherein S represents a sensitivity and Eh represents an exposure amount necessary to obtain a density of $\frac{1}{2}(D_{max}+D_{min})$, i.e., halfway between the maximum density ($D_{max}$) and the minimum density ($D_{min}$).

Surface Development A

Development is performed in a developer having the following composition for 3 minutes at 20° C.

| | |
|---|---|
| p-Hydroxy phenylglycine | 24 g |
| Sodium carbonate . monohydrate | 60.8 g |
| Sodium chloride | 2.8 g |
| Water to make | 1 l |

Internal Development (B)

A light-sensitive material is processed in a bleach solution containing 3 g/liter of potassium ferricyanide and 0.0125 g/liter of phenosafranine for 10 minutes at about 20° C., washed with water for 10 minutes, and then developed in a developer having the following composition for 10 minutes at 20° C.

| | |
|---|---|
| N-Methyl-p-aminophenol (hemisulfate) | 5 g |
| Hydroquinone | 10 g |
| Anhydrous sodium sulfite | 75 g |
| Sodium metaborate . tetrahydrate | 30 g |
| Sodium hydroxide | 10 g |
| Sodium thiosulfate | 3 g |
| Water to make | 1 l |

As the silver halide used in this invention, silver chloride, silver chlorobromide, silver iodochlorobromide, silver bromide, and silver iodobromide can be used. In the case of using silver iodobromide or silver iodochlorobromide, it is preferred that the content of silver iodide not be more than 10 mol%. Since in the process of this invention a wide range of silver halides can be used, it is possible to obtain a very high sensitivity as compared with a process using a conventional "lith" type development.

The silver halide photographic emulsions used in this invention can be prepared by the processes described in, for example, P. Glafkides, *Chimie et Physique Photographique* (published 1967 by Paul Montel); G. F. Duffin, *Photographic Emulsion Chemistry, (published* 1966, by the Focal Press); and V. L. Zelikman et al., *Making and Coating Photographic Emulsions* (published 1964 by The Focal Press). That is, the silver halide emulsions may be prepared by an acid process, a neutralization process, an ammonia process, etc., as well as the reaction of a soluble silver salt and a soluble halide may be performed by a one-side mixing process, a simultaneous mixing process, or a combination thereof. Also, a so-called reverse mixing method, wherein silver halide grains are formed in the presence of excessive amount of silver ion can be employed. In an embodiment of the simultaneous mixing method a method of manufacturing the pAg of the liquid phase wherein silver halide is formed at a constant value, that is, a so-called controlled double jet method, can be employed. According to the method, a silver halide emulsion having regular crystal form and almost uniform grain size is obtained.

Silver halide grains in the silver halide photographic emulsion used in this invention may have a relatively broad grain size distribution, but it is preferred that the emulsion has a narrow grain size distribution. In particular, it is preferred that silver halide grains occupying 90% of the total weight or number of the grains be in ±40% of the mean grain size (such a silver halide emulsion is generally called a "monodisperse" silver halide emulsion).

Silver halide grains used in this invention are preferably fine grains (e.g., less than 0.7μ) but since the compound of formula (I) provide a contrast image even if the mean grain size is large as compared with the compounds previously discovered by the inventors and improves sufficiently the dot qualities, silver halide emulsions having crude grains (e.g., larger than 0.7μ) can be used.

The silver halide grains in the silver halide photographic emulsions may be regular crystals such as cubic or octahedral crystals, or irregular crystals such as spherical or plate-like crystals, as well as composite forms of mixed crystals thereof. They may be a mixture of various crystal form grains.

The silver halide grains may have a uniform phase throughout the inside and surface layer thereof, or may be different in phase between the inside and the surface layer (e.g., a shell-core structure). Moreover, two or more sorts of silver halide emulsions prepared separately may be used as a mixture thereof.

The silver halide emulsions used in this invention may contain a cadmium salt, zinc salt, lead salt, thallium salt, iridium salt or a complex salt thereof, rhodium salt or a complex salt thereof, or an iron salt or complex salt thereof, added thereto during the formation or physical ripening of the emulsion.

As the binder or protective colloid for the silver halide emulsions, gelatin is advantageously used but other hydrophilic colloids can be also used. For example, gelatin derivatives, graft polymers of gelatin and other polymers, albumin, casein, etc.; cellulose derivatives such as hydroxyethyl cellulose, carboxymethyl cellulose, cellulose sulfate ester, etc.; sugar derivatives such as sodium alginate, a starch derivative, etc.; and various sorts of synthetic hydrophilic polymers as homopolymers or copolymers, such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc., can be used.

As the gelatin, limed gelatin and acid-processed gelatin may be used, as well as a gelatin hydrolyzed product and gelatin enzyme-decomposition product may be also used. Examples of the gelatin derivatives used in this invention are the products obtained by reacting gelatin and various compounds such as acid halide, acid anhydride, isocyanates, bromoacetic acid, alkanesultones, vinylsulfonamides, maleinimide compounds, polyalkylene oxides, epoxy compounds, etc. Practical examples of these materials are described in U.S. Pat. Nos. 2,614,928, 3,132,945, 3,186,846, 3,312,553, British Patents 861,414, 1,033,189 and 1,005,784 and Japanese Patent Publication No. 26845/67.

Examples of the aforesaid gelatin graft polymers include those prepared by grafting to gelatin a homopolymer or copolymer of a vinylic monomer such as acrylic acid, methacrylic acid, the derivative thereof such as the ester or amide, acrylonitrile, styrene, etc. In particular, a graft polymer of gelatin and a polymer having a compatibility with gelatin to some extent, such as acrylic acid, methacrylic acid, acrylamide, methacrylamide, hydroxyalkylmethacrylate, etc., is preferred. Such graft polymers are described in U.S. Pat. Nos. 2,763,625, 2,831,767 and 2,956,884. Typical examples of the synthetic hydrophilic polymers are described in West German Patent Application (OLS) No. 2,312,708, U.S. Pat. Nos. 3,620,751 and 3,879,205 and Japanese Patent Publication No. 7561/68.

It is preferred that the silver halide emulsion used in this invention does not contain more than 250 g of binder per mol of silver halide. When the silver halide emulsion contains a binder in an amount not over 250 g per mol of silver halide, extremely high contrast photographic characteristics which are the object of this invention can be more easily obtained.

After forming a precipitate or after physical ripening, soluble salts formed are usually removed from the silver halide emulsion. For this purpose, the well known noodle washing method, or a flocculation method utilizing an inorganic salt composed of a polyvalent anion, such as sodium sulfate, an anion surface active agent, an anionic polymer (e.g., polystyrenesulfonic acid), or a gelatin derivative (e.g., aliphatic-acylated gelatin, aromatic-acylated gelatin, aromatic-carbamoylated gelatin, etc.) may be used. The step of removing soluble salts may be omitted.

The silver halide emulsions used in this invention need not be chemically sensitized, but preferably are chemically sensitized. As methods for chemically sensitizing silver halide emulsions, known sulfur sensitization, reduction sensitization, and noble metal sensitization methods can be used, either solely or in combination. These sensitization methods are described in the aforesaid texts by Glafkides and Zelikman et al. as well as *Die Grundlagen der Photographischen Prozesse mit Silberhalogeniden,* edited by H. Frieser (Akademische Verlagsgesellschaft, 1968).

Of the noble metal sensitization methods, a gold sensitization method is typical and uses gold compounds, in particular gold complexes. Complexes of other noble metals than gold, such as platinum, palladium, iridium, etc., may be also used. Preferred examples thereof are described in U.S. Pat. No. 2,448,060 and British Pat. No. 618,061.

Examples of sulfur sensitizers useful for sulfur sensitization include sulfur compounds contained in gelatin as well as various sulfur compounds such as thiosulfates, thioureas, thiazoles, rhodanines, etc. Preferred examples of sulfur sensitizers are described in U.S. Pat. Nos. 1,574,944, 2,278,947, 2,410,689, 2,728,668, 3,501,313 and 3,656,955.

Examples of reduction sensitizers useful in this invention include stannous salts, amines, formamidinesulfinic acid, silane compounds, etc. Practical examples of them are described in U.S. Pat. Nos. 2,487,850, 2,518,698, 2,983,609, 2,983,610 and 2,694,637.

The light-sensitive materials of this invention may contain various compounds for preventing the formation of fog during the production step of the light-sensitive materials, as well as the preservation or photographic processing of the light-sensitive materials, or stabilizing the photographic characteristics. In more detail, the light-sensitive materials of this invention may contain known fogging agents or stabilizers as, for example, benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole, etc.), etc.; mercaptopyrimidines; mercaptotriazines; thioketo compounds such as oxazolinethione; azaindenes such as triazaindenes, tetraazaindenes (particularly, 4-hydroxy-substituted (1,3,3a,7)tetraazaindene), pentaazaindenes, etc.; benzenethiosulfonic acid, benzenesulfinic acid, benzenesulfonic acid amide, etc. Particularly preferred among these compounds are benzotriazoles (e.g., 5-methylbenzotriazole) and nitroindazoles (e.g., 5-nitroindazole). In other embodiments of the invention, these compounds may be incorporated in processing compositions.

The addition of a small amount of additive such as potassium iodide to a silver halide emulsion after the formation of silver halide grains, before chemical ripening, after chemical ripening, or before coating further increases the effect of this invention. Such iodides are suitably added in an amount of from about $10^{-4}$ to $10^{-2}$ mol/mol Ag.

The light-sensitive materials used in this invention may further contain the sensitizing dyes (e.g., cyanine dye, merocyanine dye, etc., they may be used solely or as a combination thereof), supersensitizers (e.g., aminostilbene compound, aromatic organic acid formaldehyde condensate, cadmium salt, azaindene compound, etc.), water-soluble dyes (for the purpose of filter or irradiation prevention, e.g., oxazol dyes, hemioxanol dyes, merocyanine dyes, etc.), hardeners (e.g., chromium salts, aldehydes, N-methylol compounds, dioxane derivatives, active vinyl compounds, active halogen compounds, etc.), surface active agents (e.g., known various nonionic, anionic, cationic and amphoteric surface active agents, in particular, the polyoxyalkylenes described in Japanese Patent Application (OPI) No. 37732/69 (the term "OPI" as used herein refers to a "published unexamined Japanese patent application") is useful), etc., as described hereinafter.

The polyalkylene oxides or derivatives thereof used preferably in this invention have an average molecular weight of at least 600, and the polyalkylene oxides or the derivatives thereof may be incorporated in silver halide light-sensitive materials or developers.

The polyalkylene oxide compounds used in this invention include the condensates of a polyalkylene oxide composed of at least 10 units of an alkylene oxide having from 2 to 4 carbon atoms, such as ethylene oxide, propylene-1,2-oxide, butylene-1,2-oxide, etc., preferably ethylene oxide and a compound having at least one active hydrogen atom, such as water, aliphatic alcohol, aromatic alcohol, fatty acid, organic amine, hexitol derivative, etc., and block copolymers of two or more polyalkylene oxides. Examples thereof include:

polyalkylene glycols,
polyalkylene glycol alkyl ethers,
polyalkylene glycol aryl ethers,
polyalkylene glycol alkylaryl ethers,
polyalkylene glycol esters,
polyalkylene glycol fatty acid amides,
polyalkylene glycol amines,
polyalkylene glycol block copolymers, and
polyalkylene glycol graft polymers.

The molecule may contain not only one polyalkylene oxide chain but also two or more polyalkylene oxide chains. In this case each polyalkylene oxide chain may be composed of less than 10 alkylene oxide units but the sum of the alkylene oxide units in the molecule must be at least 10. When the molecule has two or more polyalkylene oxide chains, each polyalkylene oxide chain may be composed of different alkylene oxide units, for example, ethylene oxide and propylene oxide. The polyalkylene oxide compound used in this invention contains preferably 14 to 100 alkylene oxide units.

Preferred examples of the polyalkylene oxide compounds used in this invention are as follows:

1. $HO(CH_2CH_2O)_{90}H$
2. $C_4H_9O(CH_2CH_2O)_{15}H$
3. $C_{12}H_{25}O(CH_2CH_2O)_{15}H$
4. $C_{18}H_{37}O(CH_2CH_2O)_{15}H$
5. $C_{18}H_{37}O(CH_2CH_2O)_{40}H$
6. $C_8H_{17}CH{=}CHC_8H_{16}O(CH_2CH_2O)_{15}H$

7. 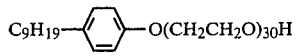

8. 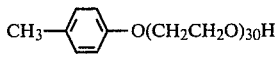

9. 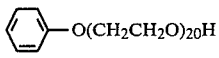

10. $C_{11}H_{23}COO(CH_2CH_2O)_{80}H$

11. $C_{11}H_{23}COO(CH_2CH_2O)_{24}OCC_{11}H_{23}$

-continued

12. $C_8H_7CH(COO(CH_2CH_2O)_9H)_2$

13. $C_{12}H_{23}CONH(CH_2CH_2O)_{15}H$

14. $C_{12}H_{25}N((CH_2CH_2O)_{15}H)_2$

15. $C_{14}H_{29}N(CH_2)(CH_2CH_2O)_{24}H$

16. $H(OCH_2CH_2)_{14}O-CH(CH_2-O-CH_2-CH_2OC_{11}H_{23})-CH(O(CH_2CH_2O)_{14}H)-CH_2-(CH_2CH_2O)_{14}H$

17. $H(CH_2CH_2O)_a(CH(CH_3)CH_2O)_b(CH_2CH_2O)_cH$ $a + b + c = 50$ $b : a + c = 10:9$

18. $HOCH_2CH_2O(CH_2CH_2O)_{50}-C_6H_4-C_9H_{19}$

19. 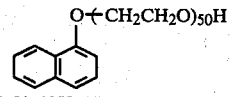

$HO(CH_2CH_2O)_a(CH_2CH_2CH_2CH_2O)_b(CH_2CH_2O)_cH$ $a + c = 30, b = 14$

20. $HO(CH_2CH_2O)_a(CH(C_6H_5)CH_2O)_b(CH_2CH_2O)_cH$ $b = 8, a + c = 50$

The above-illustrated polyalkylene oxide compounds are described in Japanese Patent Application (OPI) Nos. 156423/75 and 3217/78, and U.S. Pat. No. 4,144,069. These polyalkylene oxide compounds may be used solely or as a combination of two or more.

In the case of incorporating the polyalkylene oxide compound in a silver halide emulsion, the compound may be added to the emulsion as an aqueous solution thereof in a proper concentration or a solution thereof in a low-boiling organic solvent miscible with water in a proper period before coating, preferably after chemical ripening. The compound may be added to light-insensitive hydrophilic colloid layers such as interlayers, protective layer, filter layer, etc., without adding to silver halide emulsion.

Also, in the case of incorporating the polyalkylene oxide compound into the developer, the compound may be added to the developer as a solid or as an aqueous solution thereof in a proper concentration or a solution thereof in a low-boiling organic solvent miscible with water.

The amount of the aforesaid polyalkylene oxide compound added to a light-sensitive material of this invention is generally from about $5\times10^{-4}$ g to 5 g, and preferably from $1\times10^{-3}$ g to 1 g, per mol of silver halide.

In the case of adding the aforesaid polyalkylene oxide compound to a developer, the amount thereof is at least $1\times10^{-2}$ g, and preferably $5\times10^{-2}$ g to 40 g, per liter of the developer.

The light-sensitive materials of this invention may further contain a water-insoluble or water sparingly soluble synthetic polymer dispersion for improving the dimensional stability thereof. For example, there are polymers having, as the monomer component, alkyl acrylate, alkyl methacrylate, alkoxyalkyl acrylate, alkoxyalkyl methacrylate, glycidyl acrylate, glycidyl methacrylate, acrylamide, methacrylamide, vinyl ester (e.g., vinyl acetate), acrylonitrile, olefin, styrene, etc., solely or in a combination of them, or in a combination of these monomers and acrylic acid, methacrylic acid, $\alpha\beta$-unsaturated dicarboxylic acid, hydroxyalkyl acrylate, hydroxyalkyl methacrylate, sulfoalkyl acrylate, sulfoalkyl methacrylate, styrenesulfonic acid, etc. Preferred examples of the polymers useful in this invention are described in U.S. Pat. Nos. 2,376,005, 2,739,137, 2,853,457, 3,062,674, 3,411,911, 3,488,708, 3,525,620, 3,607,290, 3,635,715, and 3,645,740 and British Pat. Nos. 1,186,699 and 1,307,373. The high contrast silver halide emulsions of this invention are suitable for the reproduction of line images, and, since dimensional stability is important for such a use, it is preferred to incorporate the polymer dispersion in the silver halide emulsion.

In the process of this invention, the image-exposed silver halide photographic light-sensitive materials can be processed by using a stable developing solution to obtain a high-contrast image and a good dot image quality, and it is unnecessary to process said photographic light-sensitive materials by unstable lithographic developers.

As other processing solution than developing solution, known processing solution may be employed. According to the purpose, development processing forming silver image only (black and white photographic processing) or color photographic processing including development processings forming dye images can be employed. The processing temperature is usually from 18° C. to 50° C., but, as the case may be, the temperature may be below 18° C. or over 50° C.

In the case of employing black and white photographic processing the developer may contain a known developing agent. Useful developing agents include 3-pyrazolidones (e.g., 1-phenyl-3-pyrazolidone), aminophenols (e.g., N-methyl-p-aminophenol), 1-phenyl-3-pyrazolines, dihydroxybenzenes (e.g., hydroquinone), etc. These compounds may be used in combination thereof. Among these compounds, dihydroxybenzenes are preferred and the sole use of dihydroxybenzenes (in particular, hydroquinone) is particularly preferred.

The developer used in this invention generally contains preservatives, alkali agents, pH buffers, antifoggants (such as, in particular, nitroindazoles, benzotriazoles, etc.), etc., and further may contain, if necessary, dissolution aids, toning agents, development accelerators, surface active agents (preferably the polyalkylene glycols described above), defoaming agents, water softeners, hardening agents, viscosity-imparting agents, and anti-staining agents for photographic films by silver transfer (preferably the 2-mercaptobenzimidazole sulfonic acids).

According to the process of this invention, gamma higher than 10 can be obtained even when the light-sensitive materials are developed in a developer containing not less than about 0.15 mol/liter of sulfite ion. In the process of this invention the pH of the developer may be above about 9 but is preferably from about 9.5 to 12.3. If the pH of the developer is over 12.3, the developer is unstable even when the concentration of sulfite ion is high and hence it is difficult to maintain stable photographic characteristics for more than three days using such a developer.

A fix solution having a conventional composition may be used. As a fixing agent used, there are thiosulfates, thiocyanates, as well as organic sulfur compounds which are known to have an effect as a fixing agent. The fix solution may further contain a water-soluble aluminum salt as a hardening agent.

The invention will further be illustrated by the following Examples.

EXAMPLE 1

After adding aqueous ammonia to an aqueous gelatin solution maintained at 50° C., an aqueous silver nitrate solution and an aqueous solution of potassium bromide and potassium iodide were simultaneously added to the solution over a 30 minute period while maintaining the pAg at 8.1, thereby a silver iodobromie emulsion (0.8 mol% iodine) having a mean grain size of 0.35μ was prepared.

After removing soluble salts from the silver halide emulsion by an ordinary manner, sodium thiosulfate and potassium chloroaurate were added to the emulsion followed by chemical ripening for 75 minutes at 60° C.

The silver iodobromide emulsion was split into several portions and each of the compounds of this invention shown in Table 1 and comparison compounds (a), (b), (c), (d), and (e) was added to each split portion as shown in Table 1. Then, after further adding thereto a dispersion of 5-methylbenzotriazole as an antifoggant, 4-hydroxy-6-methyl-1,3,3a,7-tetraazaindene as a stabilizing agent, and polyethyl acrylate for dimensional stability, and also 2-hydroxy-4,6-dichloro-1,3,5-triazine sodium salt as a hardener, each portion was coated on a cellulose triacetate film.

Each of the light-sensitive films thus prepared was exposed through a sensitometric exposure wedge using a 150 line magenta contact screen, developed for 1 min. 40 sec. at 27° C. in a developer having the following composition, and then subjected to stop, fix, wash and dry.

| Developer | |
|---|---|
| Hydroquinone | 15 g |
| Anhydrous sodium sulfite | 40 g |
| Potassium bromide | 1 g |
| Polyethylene glycol (mean molecular weight 1,500) | 3 g |
| 5-Nitroindazole | 50 mg |
| Boric acid | 10 g |
| Water to make | 1 l |
| pH adjusted to 10 by potassium hydroxide. | |

In Table 1, the relative sensitivity is a relative value of the reciprocal of the exposure amount giving 95% blackened area and that of Sample 1 was assumed to 100. The dot quality was visually evaluated in five ranks, 5 being best, and 1 being worst, in quality. For dot original plate for making printing plate, dot quality 5 or 4 is most suitable for practical use, dot image 3 is satisfactory for practical use, and dot quality 2 or 1 is unsuitable for practical use.

In addition, the comparison compounds used in the experiment are as follows:

Comparison Compound (a)

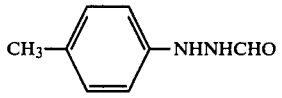

(Compound example I-2 in Japanese Patent Application (OPI) No. 16623/78.)

Comparison Compound (b)

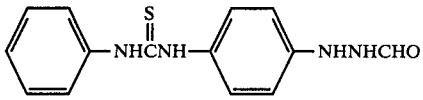

(Compound illustrated in West German Patent Application (OLS) No. 2,941,428.)

Comparison Compound (c)

$NH_2NH_2 \cdot 2HCl$ (Compound 1 in U.S. Pat. No. 2,419,975.)

Comparison Compound (d)

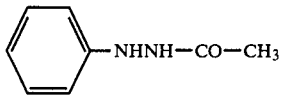

(Compound 2 in U.S. Pat. No. 3,386,831.)

Comparison Compound (e)

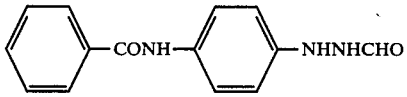

(Compound I-8 in Japanese Patent Application (OPI) No. 16623/78.)

TABLE 1

| Sample No. | Compound | Amount (mol/mol AgX) | Dot Quality | Relative Sensitivity |
|---|---|---|---|---|
| 1 | — | — | 1 | 100 |
| 2 | I-1 | $9 \times 10^{-4}$ | 4 | 240 |
| 3 | " | $4.1 \times 10^{-3}$ | 5 | 330 |
| 4 | " | $8.5 \times 10^{-3}$ | 5 | 390 |
| 5 | I-4 | $6.0 \times 10^{-3}$ | 5 | 335 |
| 6 | I-12 | $3 \times 10^{-3}$ | 4 | 290 |
| 7 | I-12 | $8.5 \times 10^{-3}$ | 5 | 320 |
| 8 | I-17 | $8.5 \times 10^{-3}$ | 5 | 315 |
| 9 | I-2 | $8.5 \times 10^{-3}$ | 5 | 310 |
| 10 | I-10 | $8.5 \times 10^{-3}$ | 5 | 302 |
| 11 | I-23 | $8.5 \times 10^{-3}$ | 5 | 305 |
| 100 | Comparison Compound (a) | $8.5 \times 10^{-3}$ | 1 | 110 |
| 101 | Comparison Compound (a) | $2.1 \times 10^{-2}$ | 2 | 115 |
| 102 | Comparison Compound (b) | $5.0 \times 10^{-4}$ | 2 | 110 |
| 103 | Comparison Compound (b) | $8.5 \times 10^{-3}$ | too much fog to evaluate | |
| 104 | Comparison Compound (c) | $8.5 \times 10^{-3}$ | 1 | 95 |
| 105 | Comparison Compound (c) | $2.6 \times 10^{-2}$ | 1 | 90 |
| 106 | Comparison Compound (d) | $8.5 \times 10^{-3}$ | 1 | 105 |
| 107 | Comparison Compound (d) | $2.6 \times 10^{-2}$ | 1 | 115 |
| 108 | Comparison Compound (e) | $2.2 \times 10^{-2}$ | 2 | 108 |

As is clear from Table 1, dot images having good quality can be obtained using the developer stably for a long period of time due to the low pH of 10.

On the other hand, in the case of using comparison compound (a), (b), or (e), dot images having good properties for practical use cannot be obtained using a developer having a pH as low as 10. In particular, in spite of that Compound 1 of this invention differs from comparison compound (b) in the point whether the 1-formyl-2-phenylhydrazone has a phenyl group substituted by a phenyl-substituted urea group or a phenyl-substituted thiourea group, it is surprising that there is a large difference between the actions and effects of the compounds in the case of using a developer having a low pH. Furthermore, in the case of using comparison compound (c) or (d), the dot quality was not improved even if a large amount of the compound was used.

EXAMPLE 2

For showing that the compounds of this invention have strong activity and clearly increase the gamma even in the case of using a developer having low pH, each of the samples as Sample Nos. 1, 2, 3, 4, 6, 10, 11, 101, 102, 104 and 106 used in Example 1 was exposed for 1 sec. under optical wedge, developed in each of three kinds of developers having the following composition and the different pH shown below, fixed, washed and dried, and thereafter the gamma was compared on the samples.

Developer (A)

| | |
|---|---|
| N-Methyl-p-aminophenol hemisulfate | 5 g |
| Hydroquinone | 10 g |
| Anhydrous sodium sulfite | 75 g |
| Sodium metaborate tetrahydrate | 10 g |
| 5-Nitroindazole | 30 mg |
| Water to make | 1 l |
| pH adjusted to 10 with potassium hydroxide | |

Developer (B)

Same composition as developer (A) but adjusted to pH 10.7.

Developer (C)

Same composition as developer (A) but adjusted to pH 11.5.

The results are shown in Table 2.

TABLE 2

| Sample No. | Developer (A) (pH = 10) | Developer (B) (pH = 10.7) | Developer (C) (pH = 11.5) |
|---|---|---|---|
| 1 | 3.5 | 3.6 | 3.8 |
| 2 | 10 | 17 | >20 |
| 3 | 14 | 19 | >20 |
| 4 | 17 | >20 | fog |
| 6 | 13 | 19 | >20 |
| 10 | 15 | >20 | >20 |
| 11 | 14 | >20 | >20 |
| 101 | 3.5 | 4.5 | 18 |
| 102 | 3.5 | 6.5 | 20 |
| 104 | 3.5 | 3.5 | 3.5 |
| 106 | 3.5 | 4.0 | 7.5 |

As is shown in Table 2, the compounds of this invention greatly increased gamma when using developer having low pH. On the other hand, in the case of using comparison compounds (a), (b) and (c), high contrast was not obtained without fairly increasing the pH (e.g., developer (C)).

EXAMPLE 3

After adding aqueous ammonia to an aqueous gelatin solution containing potassium bromide and potassium iodide maintained at 75° C., an aqueous silver nitrate solution and an aqueous potassium bromide solution were simultaneously added to the mixture, thereby a crude grain silver iodobromide emulsion (0.5 mol% iodine) having a mean grain size of 0.85$\mu$ was prepared.

After removing soluble salts from the emulsion, sodium thiosulfate and potassium chloroaurate were added to the emulsion to perform chemical ripening.

The crude grain silver iodobromide emulsion was split into several portions and after adding thereto each of the compounds of this invention shown in Table 3 and comparison compounds (a), (b) and (d) and further each of 1-ethyl-5-[2-(3-ethyl-2-(3H)-thiazolinydene)ethylidene]rhodanine, dispersion of 5-methylbenzotriazole and polyethyl acrylate, and bis(vinylsulfonyl)-2-hydroxypropane, each portion was coated on a cellulose triacetate film.

After exposing each of the light-sensitive films through an exposure wedge for sensitometry using a 150 line magenta contact screen, the light-sensitive material was developed for 1 min. 40 sec. at 27° C. in a developer having the following composition, and subjected to steps of stop, fix, wash, and dry. Thereafter, the dot quality was determined. The evaluation of the dot quality was the same as in Example 1.

| Developer | |
|---|---|
| Hydroquinone | 25 g |
| Anhydrous sodium sulfite | 45 g |
| Potassium bromide | 1 g |
| Polyethylene glycol (mean molecular weight 4,000) | 5 g |
| 5-Nitroindazole | 100 mg |
| Sodium 2-mercaptobenzimidazole-5-sulfonate | 300 mg |
| Boric acid | 10 g |
| Water to make | 1 l |
| pH adjusted to 11.1 with potassium hydroxide. | |

The results are shown in the following table.

TABLE 3

| Compound | Addition Amount (mol/mol Ag) | Dot Quality |
|---|---|---|
| — | — | 1 |
| I-1 | $4 \times 10^{-3}$ | 3 |
| " | $8 \times 10^{-3}$ | 3-4 |
| I-6 | $4 \times 10^{-3}$ | 3 |
| " | $8 \times 10^{-3}$ | 4 |
| I-23 | $8 \times 10^{-3}$ | 4 |
| Comparison Compound (a) | $2.4 \times 10^{-2}$ | 1-2 |
| Comparison Compound (b) | $8.5 \times 10^{-4}$ | 1-2 |
| Comparison Compound (c) | $2.6 \times 10^{-2}$ | 1 |

As is clear from Table 3, the compounds of this invention greatly improved the dot quality, even in the case of using silver halide emulsions having comparatively large grain sizes.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising at least one silver halide photographic emulsion layer consisting essentially of surface latent image-type silver halide grains, wherein at least one layer contains a compound represented by formula (I) in an amount sufficient to improve dot quality and contrast,

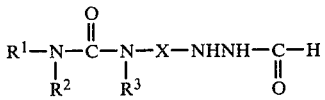

(I)

wherein $R^1$ and $R^2$ each represents hydrogen, an aliphatic hydrocarbon group, an aryl group, or a heterocyclic group; $R^3$ represents hydrogen or an aliphatic hydrocarbon group; and X represents a divalent aryl group.

2. A silver halide photographic light-sensitive material as in claim 1 wherein the compound represented by formula (I) is incorporated in said silver halide photographic emulsion layer.

3. A silver halide photographic light-sensitive material as in claim 1 wherein the compound represented by formula (I) is incorporated in a non-light-sensitive layer.

4. A silver halide photographic light-sensitive material as in claim 1, 2, or 3 wherein $R^1$ and $R^2$ each represents hydrogen, an alkyl group which may be substituted, a cycloalkyl group which may be substituted, an alkenyl group, an alkynyl group, a phenyl group which may be substituted, a naphthyl group which may be substituted, or a 5- or 6-membered heterocyclic group having at least one of oxygen, nitrogen, sulfur and selenium, which may be substituted.

5. A silver halide photographic light-sensitive material as in claim 4 wherein at least one of $R^1$ and $R^2$ represents hydrogen.

6. A silver halide photographic light-sensitive material as in claim 1, 2, or 3 wherein $R^3$ represents hydrogen, an alkyl group which may be substituted, a cycloalkyl group which may be substituted, an alkenyl group or an alkynyl group.

7. A silver halide photographic light-sensitive material as in claim 6 wherein $R^3$ represents hydrogen.

8. A silver halide photographic light-sensitive material as in claim 1, 2 or 3 wherein X represents a phenylene group which may be substituted, or a naphthylene group which may be substituted.

9. A silver halide photographic light-sensitive material as in claim 1, 2, or 3 wherein $R^2$ and $R^3$ both represent hydrogen.

10. A silver halide photographic light-sensitive material as in claim 1, 2, or 3 wherein the silver halide emulsion is a monodisperse silver halide emulsion.

11. A silver halide photographic light-sensitive material as in claim 1, 2, or 3 wherein the light-sensitive material contains compound represented by formula (I) in an amount of from about $10^{-6}$ to $5\times10^{-2}$ mol per mol of silver halide.

12. A silver halide photographic light-sensitive material as in claim 1, 2, or 3 wherein the light-sensitive material contains the compound represented by formula (I) in an amount of from $10^{-5}$ to $2\times10^{-2}$ mol per mol of silver halide.

13. A silver halide photographic light-sensitive material as in claim 1, 2, or 3 wherein the silver halide photographic emulsion contains a binder in an amount of less than 250 g per mol of silver halide.

14. A silver halide photographic light-sensitive material as in claim 1, 2, or 3 wherein a polyalkylene oxide having an average molecular weight of at least 600 is incorporated therein.

15. A process for forming a photographic image which comprises developing the silver halide photographic light-sensitive material comprising at least one silver halide photographic emulsion layer consisting essentially of surface latent image-type silver halide grains, wherein at least one layer contains a compound represented by formula (I) in an amount sufficient to improve dot quality and contrast,

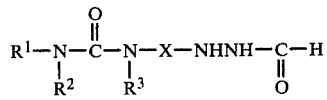

(I)

wherein $R^1$ and $R^2$ each represents hydrogen, an aliphatic hydrocarbon group, an aryl group, or a heterocyclic group;

$R^3$ represents hydrogen or an aliphatic hydrocarbon group; and

X represents a divalent aryl group;

by a developer containing a dihydroxybenzene.

16. A process for forming a photographic image as in claim 15 wherein a silver halide photographic material is developed in the presence of polyethylene oxide having an average molecular weight of more than 600.

17. A process for forming a photographic image as in claim 15 wherein a silver halide photographic light-sensitive material is developed by a developer having a pH of from 9.0 to 12.3 and containing sulfite ion in an amount of more than 0.15 mol/liter.

18. A process for forming a photographic image as in claim 15 wherein the silver halide photographic light-sensitive material is developed in the presence of a benzotriazole.

19. A process for forming a photographic image as in claim 15 wherein the silver halide photographic light-sensitive material is developed in the presence of a nitroindazole.

* * * * *